US010966497B2

(12) United States Patent
Wang

(10) Patent No.: US 10,966,497 B2
(45) Date of Patent: Apr. 6, 2021

(54) HANDLE ASSEMBLY FOR LUGGAGE

(71) Applicant: Hsuen-Hsuan Wang, Miaoli (TW)

(72) Inventor: Hsuen-Hsuan Wang, Miaoli (TW)

( * ) Notice: Subject to any disclaimer, the term of this patent is extended or adjusted under 35 U.S.C. 154(b) by 25 days.

(21) Appl. No.: 16/397,044

(22) Filed: Apr. 29, 2019

(65) Prior Publication Data

US 2020/0337430 A1 Oct. 29, 2020

(51) Int. Cl.

| | |
|---|---|
| ***A45C 13/26*** | (2006.01) |
| ***A45C 15/06*** | (2006.01) |
| *F21S 4/24* | (2016.01) |
| *F21Y 115/10* | (2016.01) |

(52) U.S. Cl.

CPC ..... *A45C 13/262* (2013.01); *A45C 15/06* (2013.01); *A45C 2013/267* (2013.01); *F21S 4/24* (2016.01); *F21Y 2115/10* (2016.08)

(58) Field of Classification Search

CPC ..... A45C 15/06; A45C 13/262; Y10T 16/451
See application file for complete search history.

(56) References Cited

U.S. PATENT DOCUMENTS 3,500,973 A * 3/1970 Bush ..... A45C 13/26 16/114.1
5,709,005 A * 1/1998 Brach, Jr. ..... A47L 13/11 15/143.1
5,909,760 A * 6/1999 Tsai ..... A45C 13/262 16/429
7,467,696 B2 * 12/2008 Wu ..... A45C 13/262 16/113.1
8,353,081 B2 * 1/2013 Lai ..... A45C 13/262 16/113.1
8,646,584 B2 * 2/2014 Moussatche ..... A45C 13/262 16/113.1
8,960,959 B2 * 2/2015 Chen ..... A45C 13/26 16/113.1
9,233,703 B2 * 1/2016 Kassab Arabo ..... B62B 3/00
9,700,164 B2 * 7/2017 Klugh ..... A47G 23/0225
9,872,547 B2 * 1/2018 Naiva ..... A45C 13/262
D863,766 S * 10/2019 Truong ..... A45C 13/262 D3/318
2003/0084541 A1 * 5/2003 Liang ..... A45C 13/262 16/113.1
2008/0053771 A1 * 3/2008 Wu ..... A45C 13/262 190/115
2008/0235912 A1 * 10/2008 Godshaw ..... A45C 13/262 16/430
2009/0107788 A1 * 4/2009 Lin ..... A45C 13/262 190/115

(Continued)

*Primary Examiner* — Victor D Batson
*Assistant Examiner* — Matthew J Sullivan
(74) *Attorney, Agent, or Firm* — Alan D. Kamrath; Karin L. Williams; Mayer & Williams PC

(57) ABSTRACT

A handle assembly for a luggage includes a handle and two inner tube units mounted on two sides of the handle. Each of the two inner tube units includes an inner tube and at least one decorative piece mounted on the inner tube. The inner tube of each of the two inner tube units is provided with at least one mounting groove. The at least one decorative piece of each of the two inner tube units is mounted in the at least one mounting groove of the inner tube. The at least one decorative piece of each of the two inner tube units is molded with different colors according to requirements of different users.

9 Claims, 9 Drawing Sheets

(56) References Cited

U.S. PATENT DOCUMENTS

| | | | | |
|---|---|---|---|---|
| 2014/0041977 | A1* | 2/2014 | Chang | A45C 13/262<br>190/115 |
| 2014/0291096 | A1* | 10/2014 | Chang | A45C 13/262<br>190/115 |
| 2015/0342318 | A1* | 12/2015 | Arthur | A45C 13/262<br>280/655.1 |
| 2016/0235175 | A1* | 8/2016 | Jose | A45C 13/28 |
| 2019/0183221 | A1* | 6/2019 | Lai | A45C 13/262 |
| 2019/0281941 | A1* | 9/2019 | Liang | A45C 5/03 |
| 2019/0307219 | A1* | 10/2019 | Tan | A45C 13/262 |

* cited by examiner

HANDLE ASSEMBLY FOR LUGGAGE

BACKGROUND OF THE INVENTION

1. Field of the Invention

The present invention relates to a handle assembly and, more particularly, to a pull handle assembly for a luggage (or luggage carrier), a suitcase or the like.

2. Description of the Related Art

A conventional luggage in accordance with the prior art shown in FIGS. 1-3 comprises a luggage body 13 and a handle assembly 10 mounted on the luggage body 13. The handle assembly 10 includes a handle 11, two outer tubes mounted in the luggage body 13, and two inner tubes 12 mounted on two sides of the handle 11 and movably mounted in the outer tubes. Each of the two inner tubes 12 has a light weight such that each of the two inner tubes 12 has a smaller thickness as show in FIG. 3, thereby decreasing the strength of each of the two inner tubes 12, such that each of the two inner tubes 12 is easily deformed when subjected to a hit or an impact. In addition, each of the two inner tubes 12 only has a single color, thereby decreasing the aesthetic quality of the handle assembly 10.

BRIEF SUMMARY OF THE INVENTION

The primary objective of the present invention is to provide a handle assembly that has a reinforced strength and has diverse color variations.

In accordance with the present invention, there is provided a handle assembly comprising a handle and two inner tube units mounted on two sides of the handle. Each of the two inner tube units includes an inner tube and at least one decorative piece mounted on the inner tube. The inner tube of each of the two inner tube units is provided with at least one mounting groove. The at least one decorative piece of each of the two inner tube units is mounted in the at least one mounting groove of the inner tube. The at least one decorative piece of each of the two inner tube units is molded with different colors or color systems.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
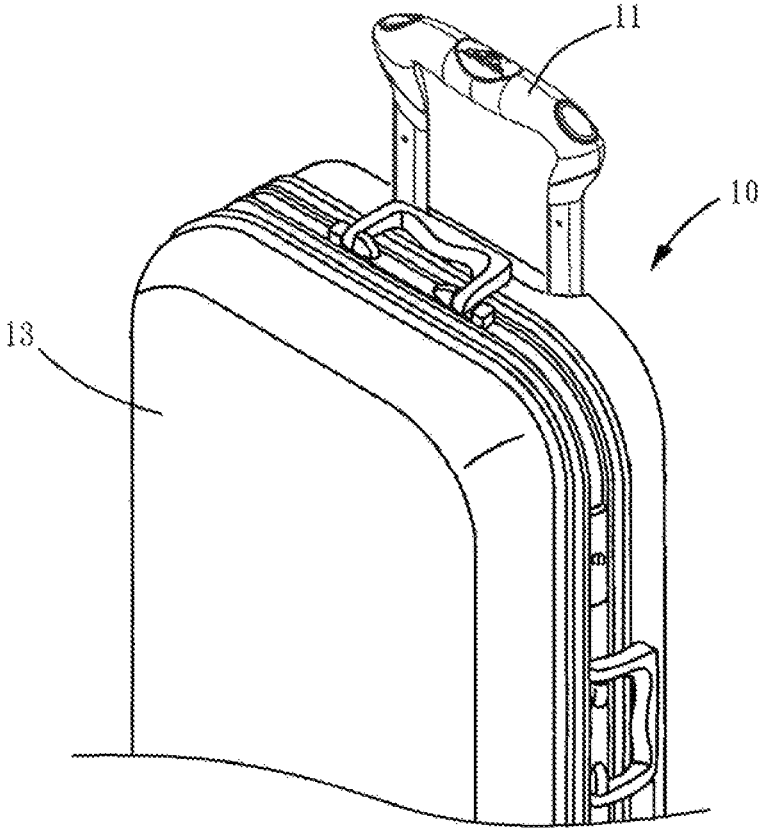
FIG. 1 PRIOR ART
FIG. 1 is a perspective view of a conventional handle assembly for a luggage in accordance with the prior art.
Figure 2:
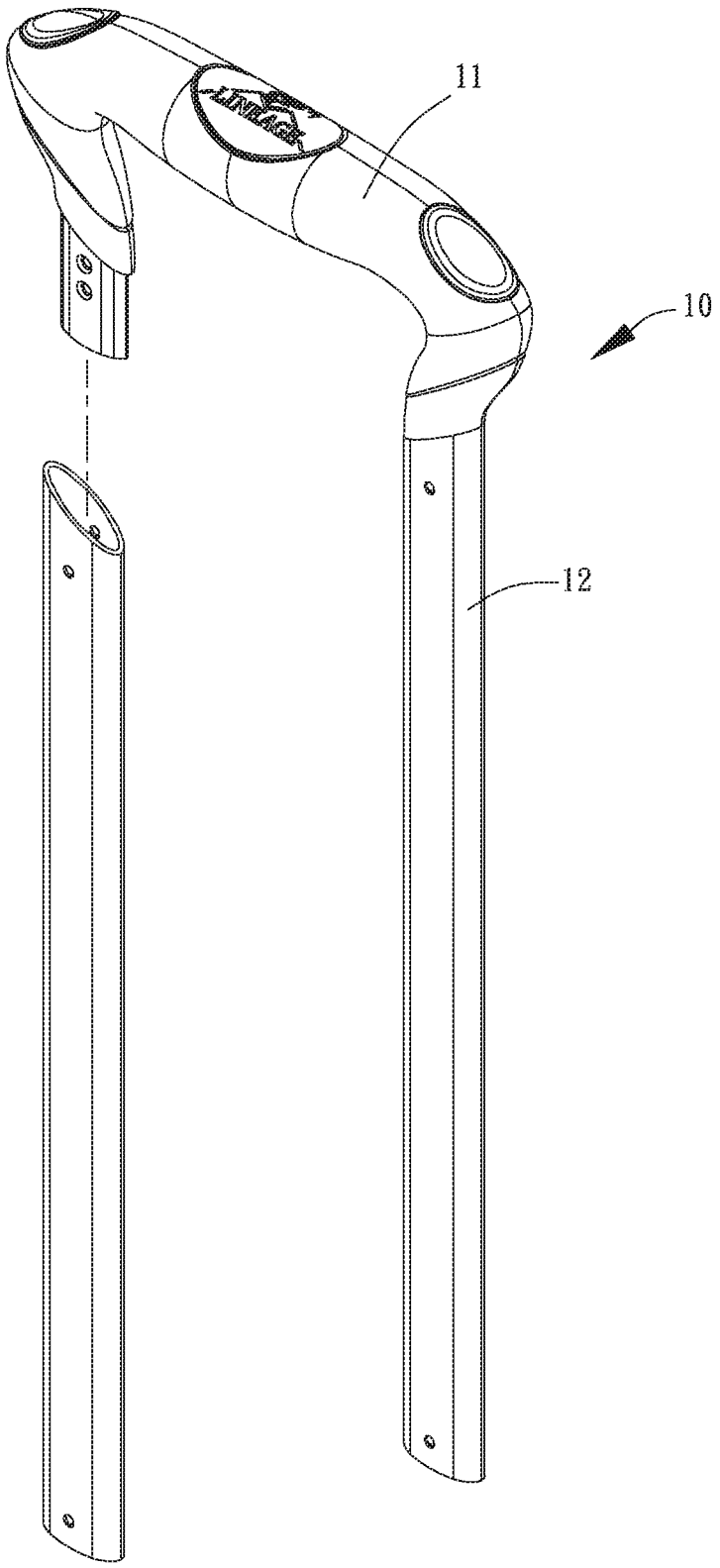
FIG. 2 PRIOR ART
FIG. 2 is an exploded perspective view of the conventional handle assembly for a luggage in accordance with the prior art.
Figure 3:
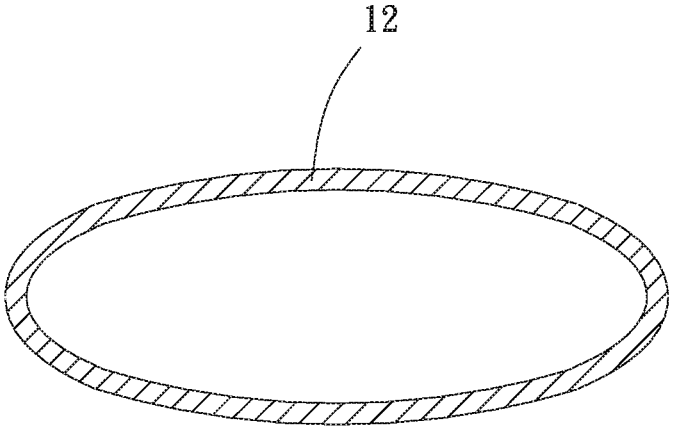
FIG. 3 PRIOR ART
FIG. 3 is a cross-sectional view of an inner tube of the conventional handle assembly for a luggage in accordance with the prior art.
Figure 4:
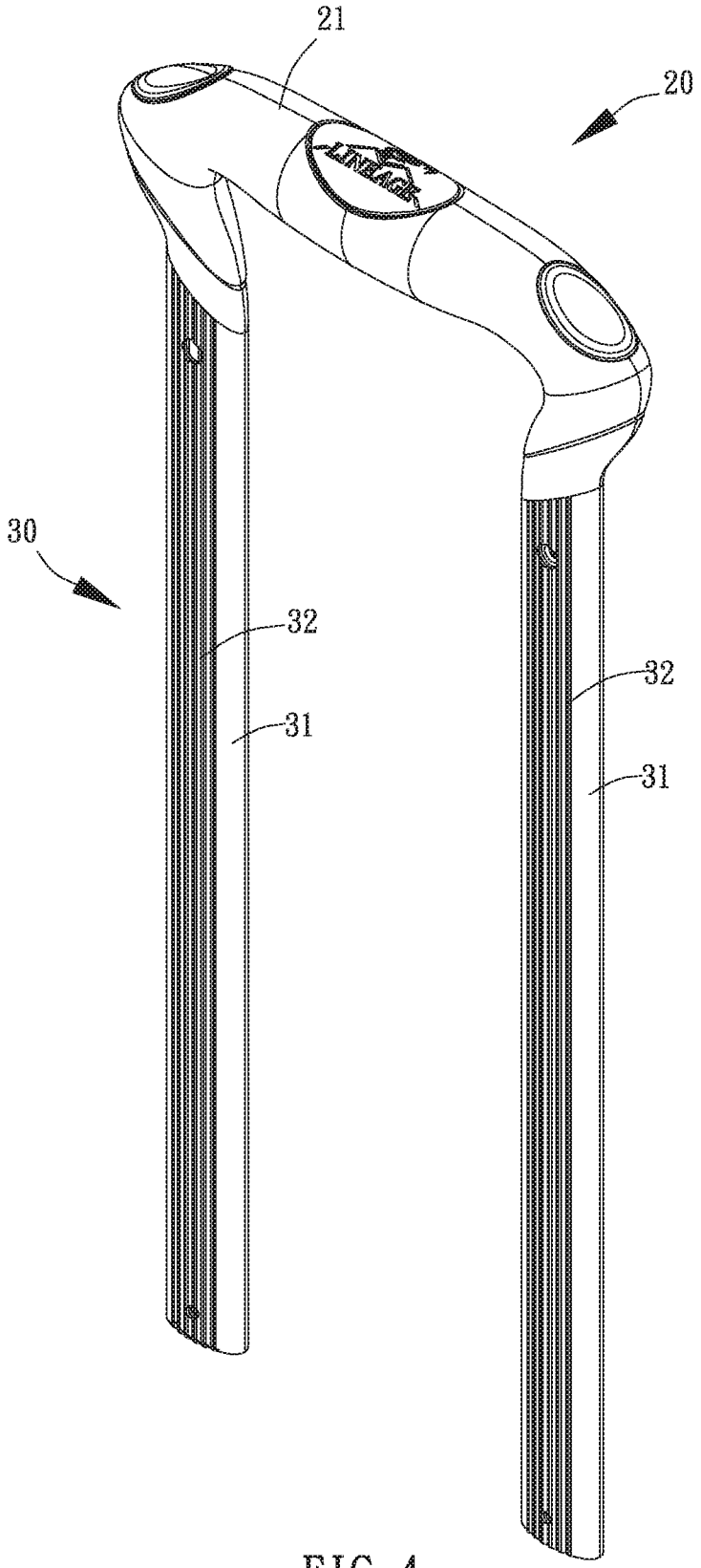
FIG. 4 is a perspective view of a handle assembly for a luggage in accordance with the preferred embodiment of the present invention.
Figure 5:
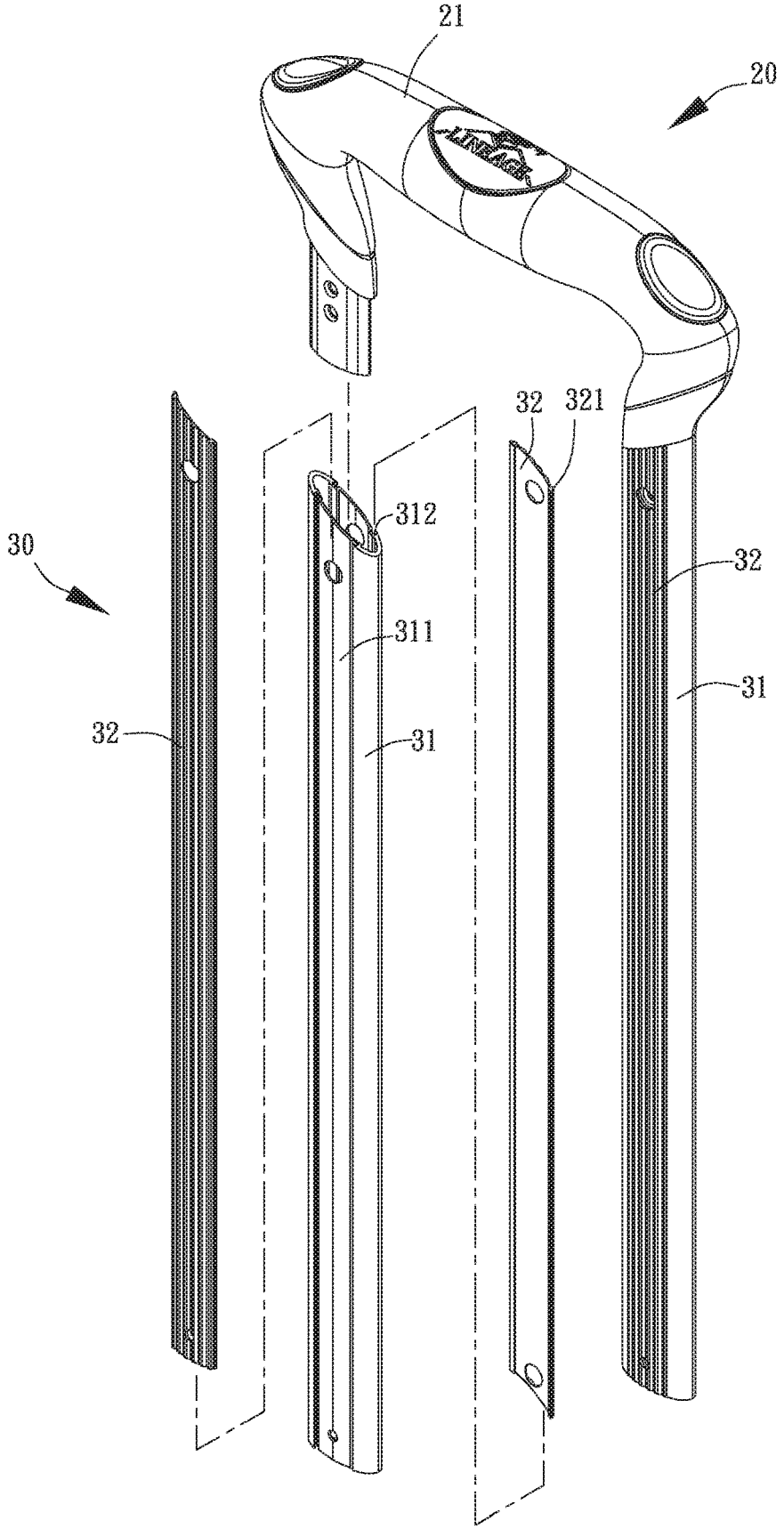
FIG. 5 is an exploded perspective view of the handle assembly in accordance with the preferred embodiment of the present invention.
Figure 7:
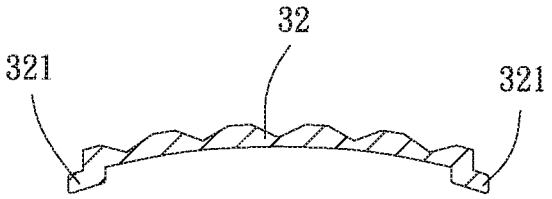
FIG. 7 is a cross-sectional view of a decorative piece of the handle assembly in accordance with the preferred embodiment of the present invention.
Figure 6:
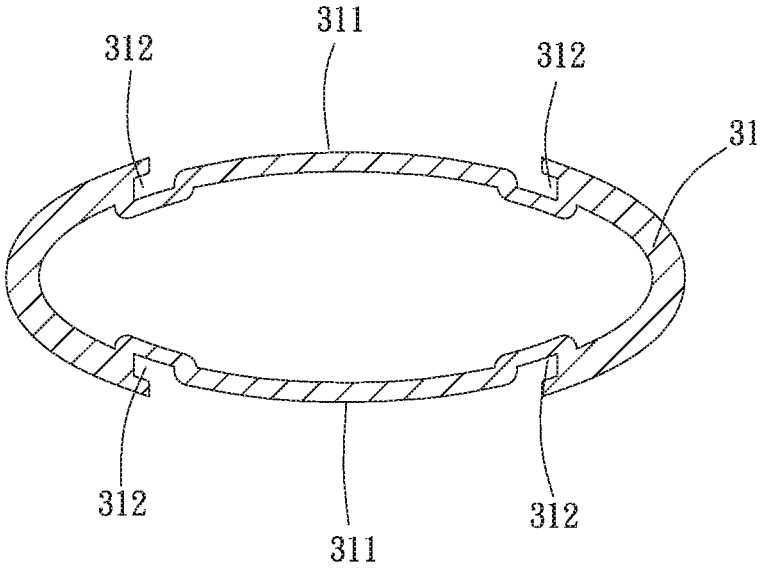
FIG. 6 is a cross-sectional view of an inner tube of the handle assembly in accordance with the preferred embodiment of the present invention.
Figure 8:
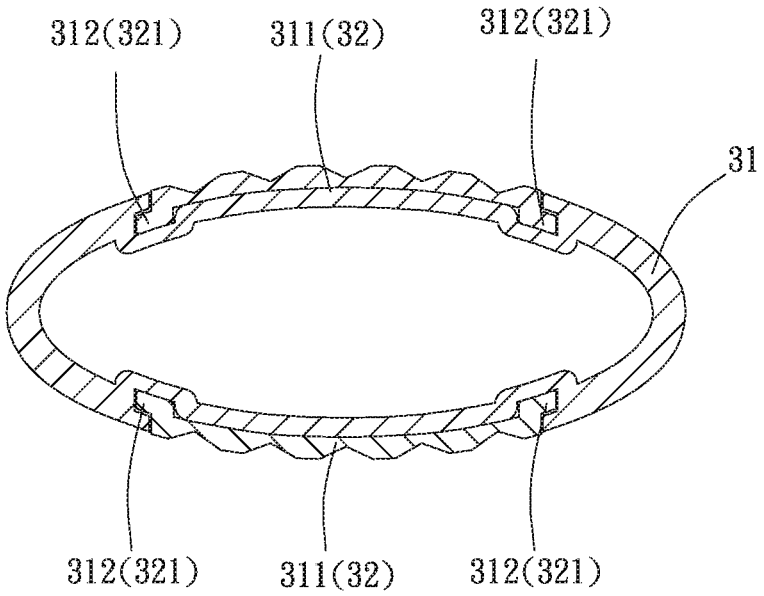
FIG. 8 is a cross-sectional assembly view of the inner tube and the decorative piece of the handle assembly in accordance with the preferred embodiment of the present invention.

Referring to the drawings and initially to FIGS. 4-8, a handle assembly 20 for a luggage in accordance with the preferred embodiment of the present invention comprises a handle 21 and two inner tube units 30 mounted on two sides of the handle 21.

Each of the two inner tube units 30 includes an inner tube 31 and at least one decorative piece 32 mounted on the inner tube 31.

The inner tube 31 of each of the two inner tube units 30 has a hollow shape and is provided with at least one mounting groove 311.

The at least one decorative piece 32 of each of the two inner tube units 30 is mounted in the at least one mounting groove 311 of the inner tube 31. The at least one decorative piece 32 of each of the two inner tube units 30 has a sheet or strip shape and is molded with different colors or color systems according to a requirement.

In the preferred embodiment of the present invention, the inner tube 31 of each of the two inner tube units 30 is recessed with two mounting grooves 311. Each of the two mounting grooves 311 extends from an exterior of the inner tube 31 toward an interior of the inner tube 31. Each of the two inner tube units 30 includes two decorative pieces 32 mounted in the two mounting grooves 311 of the inner tube 31.

In the preferred embodiment of the present invention, the at least one mounting groove 311 of the inner tube 31 has two sides each provided with a limit slot 312. The at least one decorative piece 32 of each of the two inner tube units 30 has two ends each provided with a limit strip 321 mounted in the respective limit slot 312 of the at least one mounting groove 311 of the inner tube 31. Preferably, the at least one decorative piece 32 of each of the two inner tube units 30 slides into the at least one mounting groove 311 of the inner tube 31 from the top or the bottom of the inner tube 31, and the limit strip 321 of the at least one decorative piece 32 of each of the two inner tube units 30 slides into the limit slot 312 of the at least one mounting groove 311 of the inner tube 31.

In the preferred embodiment of the present invention, the at least one decorative piece 32 and the inner tube 31 of each of the two inner tube units 30 present relative or corresponding color systems.

Alternatively, the at least one decorative piece 32 and the inner tube 31 of each of the two inner tube units 30 present contrast color systems.

Alternatively, the at least one decorative piece 32 and the inner tube 31 of each of the two inner tube units 30 present different color systems.

In the preferred embodiment of the present invention, the at least one decorative piece 32 of each of the two inner tube units 30 is a light reflection strip.

Alternatively, the at least one decorative piece 32 of each of the two inner tube units 30 is an LED strip.

In assembly, the at least one decorative piece 32 of each of the two inner tube units 30 extends and slides into the at least one mounting groove 311 of the inner tube 31, with the limit strip 321 of the at least one decorative piece 32 being restricted in the limit slot 312 of the inner tube 31. Then, the upper end of the inner tube 31 of each of the two inner tube units 30 is fitted onto the handle 21 and is fastened by rivets.

Accordingly, the inner tube 31 is a hollow tube and is recessed with two mounting grooves 311, such that the inner tube 31 is a non-uniform central tube with an increased cross-sectional area, so as to reinforce the strength of the inner tube 31 by provision of the two mounting grooves 311, and to enhance the hit resistant capacity of the inner tube 31. In addition, the at least one decorative piece 32 is molded with different colors according to the use's requirement, while the at least one decorative piece 32 and the inner tube 31 present relative, contrast or different color systems, such that the inner tube 31 cooperate with the at least one decorative piece 32 to provide diverse variation of colors so as to facilitate the users selecting the colors, and to enhance the aesthetic quality of the luggage. Further, the at least one decorative piece 32 is a light reflection strip to protect the user's safety when dragging the luggage at night or on a dark place. Further, the at least one decorative piece 32 is an LED strip to provide a blinking or dazzling visible effect.

Figure 9:
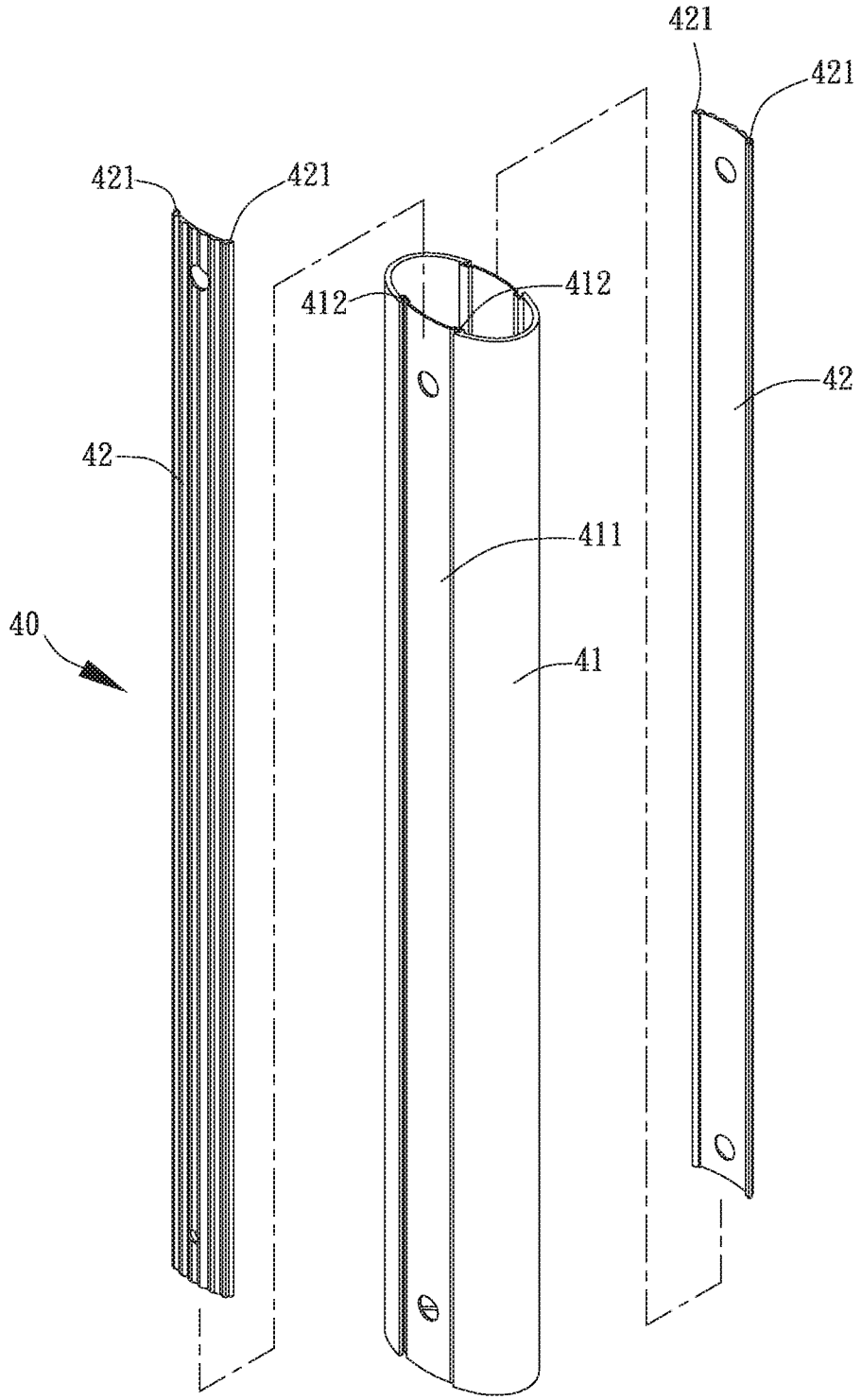
FIG. 9 is an exploded perspective view of an outer tube unit of the handle assembly in accordance with the preferred embodiment of the present invention.
Figure 10:
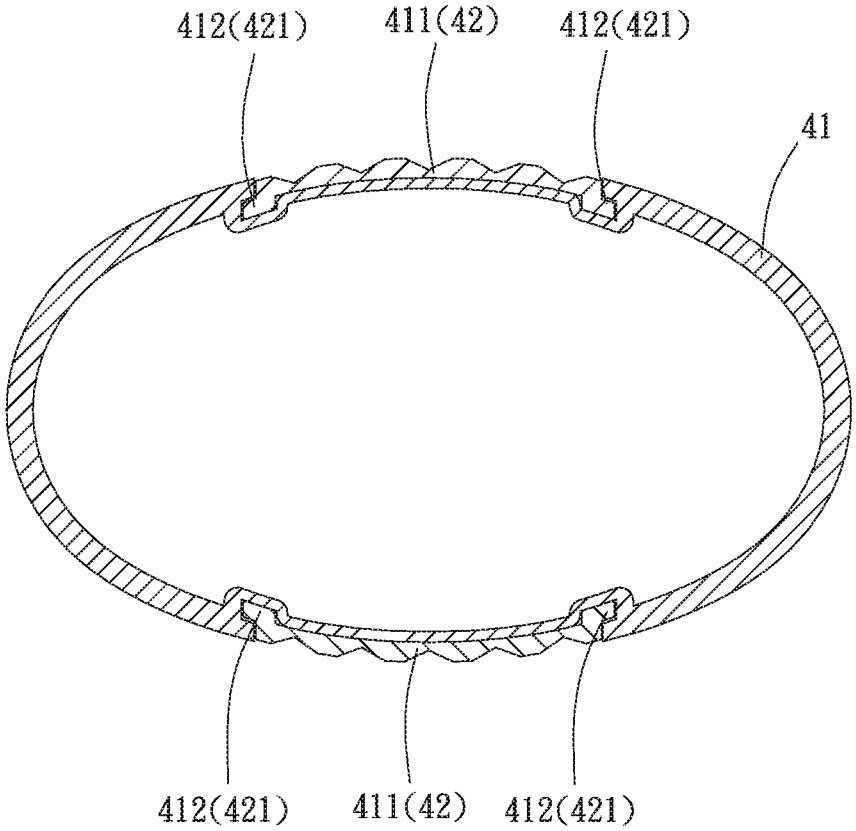
FIG. 10 is a cross-sectional assembly view of the outer tube unit of the handle assembly as shown in FIG. 9.

Referring to FIGS. 9 and 10 with reference to FIGS. 1-8, the handle assembly 20 further comprises two outer tube units 40 mounted in the luggage. The two inner tube units 30 are mounted in the two outer tube units 40 respectively. Each of the two outer tube units 40 includes an outer tube 41 and at least one secondary decorative piece 42 mounted on the outer tube 41.

The outer tube 41 of each of the two outer tube units 40 has a hollow shape and is provided with at least one secondary mounting groove 411.

The at least one secondary decorative piece 42 of each of the two outer tube units 40 is mounted in the at least one secondary mounting groove 411 of the outer tube 41. The at least one secondary decorative piece 42 of each of the two outer tube units 40 has a sheet or strip shape and is molded with different colors or color systems according to a requirement.

In the preferred embodiment of the present invention, the outer tube 41 of each of the two outer tube units 40 is recessed with two secondary mounting grooves 411. Each of the two secondary mounting grooves 411 extends from an exterior of the outer tube 41 toward an interior of the outer tube 41. Each of the two outer tube units 40 includes two secondary decorative pieces 42 mounted in the two secondary mounting grooves 411 of the outer tube 41.

In the preferred embodiment of the present invention, the at least one secondary mounting groove 411 of the outer tube 41 has two sides each provided with a secondary limit slot 412. The at least one secondary decorative piece 42 of each of the two outer tube units 40 has two ends each provided with a secondary limit strip 421 mounted in the respective secondary limit slot 412 of the at least one secondary mounting groove 411 of the outer tube 41. Preferably, the at least one secondary decorative piece 42 of each of the two outer tube units 40 slides into the at least one secondary mounting groove 411 of the outer tube 41 from the top or the bottom of the outer tube 41, and the secondary limit strip 421 of the at least one secondary decorative piece 42 of each of the two outer tube units 40 slides into the secondary limit slot 412 of the at least one secondary mounting groove 411 of the outer tube 41.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A handle assembly comprising:

a handle; and two inner tube units mounted on two sides of the handle; wherein:

each of the two inner tube units includes an inner tube and at least one decorative piece mounted on the inner tube;

the inner tube of each of the two inner tube units is provided with at least one mounting groove;

the at least one decorative piece of each of the two inner tube units is an LED strip; and the at least one decorative piece of each of the two inner tube units is mounted in the at least one mounting groove of the inner tube.

2. The handle assembly of claim 1, wherein:

the inner tube of each of the two inner tube units is recessed with two mounting grooves;

each of the two mounting grooves extends from an exterior of the inner tube toward an interior of the inner tube; and each of the two inner tube units includes two decorative pieces mounted in the two mounting grooves of the inner tube.

3. The handle assembly of claim 1, wherein the at least one mounting groove of the inner tube has two sides each provided with a limit slot, and the at least one decorative piece of each of the two inner tube units has two ends each provided with a limit strip mounted in the respective limit slot of the at least one mounting groove of the inner tube.

4. The handle assembly of claim 1, wherein the at least one decorative piece and the inner tube of each of the two inner tube units present corresponding color systems.

5. The handle assembly of claim 1, wherein the at least one decorative piece and the inner tube of each of the two inner tube units present contrast color systems or different color systems.

6. The handle assembly of claim 1, wherein the at least one decorative piece of each of the two inner tube units is a light reflection strip.

7. The handle assembly of claim 1, further comprising:

two outer tube units;

wherein:

the two inner tube units are mounted in the two outer tube units respectively;

each of the two outer tube units includes an outer tube and at least one secondary decorative piece mounted on the outer tube;

the outer tube of each of the two outer tube units is provided with at least one secondary mounting groove;

the at least one secondary decorative piece of each of the two outer tube units is mounted in the at least one secondary mounting groove of the outer tube; and the at least one secondary decorative piece of each of the two outer tube units is molded with different colors or color systems.

8. The handle assembly of claim 7, wherein:

the outer tube of each of the two outer tube units is recessed with two secondary mounting grooves;

each of the two secondary mounting grooves extends from an exterior of the outer tube toward an interior of the outer tube; and each of the two outer tube units includes two secondary decorative pieces mounted in the two secondary mounting grooves of the outer tube.

9. The handle assembly of claim 7, wherein the at least one secondary mounting groove of the outer tube has two sides each provided with a secondary limit slot, and the at least one secondary decorative piece of each of the two outer tube units has two ends each provided with a secondary limit strip mounted in the respective secondary limit slot of the at least one secondary mounting groove of the outer tube.

* * * * *